US006530690B2

(12) United States Patent
Smith et al.

(10) Patent No.: US 6,530,690 B2
(45) Date of Patent: Mar. 11, 2003

(54) SLOT MACHINE COIN CONTAINER

(76) Inventors: Garry L. Smith, 123 Heien Ct., Boyd, TX (US) 76023; Pennie J. Nelva Smith, 123 Heien Ct., Boyd, TX (US) 76023

( * ) Notice: Subject to any disclaimer, the term of this patent is extended or adjusted under 35 U.S.C. 154(b) by 140 days.

(21) Appl. No.: 09/783,110

(22) Filed: Feb. 14, 2001

(65) Prior Publication Data

US 2002/0110288 A1 Aug. 15, 2002

Related U.S. Application Data

(60) Provisional application No. 60/247,417, filed on Nov. 13, 2000.

(51) Int. Cl.[7] ..... B65D 33/06
(52) U.S. Cl. ..... 383/12; 383/33
(58) Field of Search ..... 383/12, 33; 220/9.4; 248/99, 100

(56) References Cited

U.S. PATENT DOCUMENTS 1,265,996 A * 5/1918 Cerny ..... 383/33 X
1,458,640 A * 6/1923 Chase ..... 383/33 X
2,544,075 A * 3/1951 Ernst et al. ..... 383/33
3,105,617 A * 10/1963 Felldin ..... 220/9.4 X
3,653,586 A 4/1972 Bonneson
4,919,546 A * 4/1990 Imazeki et al. ..... 383/33
4,974,761 A 12/1990 Luque
5,033,232 A * 7/1991 Vaugh ..... 220/9.4 X
5,158,220 A 10/1992 Glass
5,830,056 A 11/1998 Adams et al.

FOREIGN PATENT DOCUMENTS

JP 0064901 * 3/1989 ..... 383/33

* cited by examiner

*Primary Examiner*—Jes F. Pascua
(74) *Attorney, Agent, or Firm*—Sturm & Fix LLP

(57) ABSTRACT

A coin receiving and carrying container adapted for use with a slot machine. The coin container includes a frame having a bag supporting section and a handle section that may be formed of a continuous round rod. A flexible bag that may be formed of durable cloth is attached to the bag supporting section of the frame and depends downwardly therefrom. The bag supporting section of the frame and the attached bag are shaped to conform to the generally rectangularly shaped coin tray of a slot machine and may be easily and conveniently positioned in the coin tray below the coin discharge. Coins discharged into the bag may be easily carried to the casino cashier by grasping the handle with the frame in the vertical position.

4 Claims, 1 Drawing Sheet

SLOT MACHINE COIN CONTAINER

CROSS REFERENCE TO RELATED APPLICATIONS

This application contains disclosure from and claims the benefit under Title 35 United States Code §119(e) of U.S. Provisional Application Ser. No. 60/247,417, filed Nov. 13, 2000 and entitled "Slot Buddy.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of accessories to be used with slot machines, and more particularly a coin receiving and carrying container.

2. Description of Related Art

As can be seen by reference to the following U.S. Pat. Nos. 3,654,586; 4,974,761; 5,158,220 and 5,830,056, the prior art is replete with myraid and diverse coin containers.

While all of the aforementioned prior art constructions are more than adequate for the basic purpose and function for which they have been specifically designed, they are uniformly deficient with respect to their failure to provide a simple, efficient, and practical coin receiving and carrying container adopted for use with a slot machine.

It is not uncommon for patrons to scrape their hands in the process of removing coins from the coin tray of a slot machine. Also, it is a cumbersome task since hand access to the coin tray is limited by the narrow clearance between the coin tray and the coin discharge. This is particularly difficult for elderly or arthritic patrons.

As a consequence of the foregoing situation, there has existed a longstanding need for a new and improved slot machine coin container and the provision of such a construction is a stated objective of the present invention.

BRIEF SUMMARY OF THE INVENTION

Briefly stated, the present invention provides a coin receiving and carrying container adapted for use with a slot machine. The coin container includes a frame having a bag supporting section and a handle section that may be formed of a continuous round rod. A flexible bag that may be formed of durable cloth is attached to the bag supporting section of the frame and depends downwardly therefrom. The bag supporting section of the frame and the attached bag are shaped to conform to the generally rectangularly shaped coin tray of a slot machine and may be easily and conveniently positioned in the coin tray below the coin discharge. Coins discharged into the bag may be easily carried to the casino cashier by grasping the handle with the frame in the vertical position.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
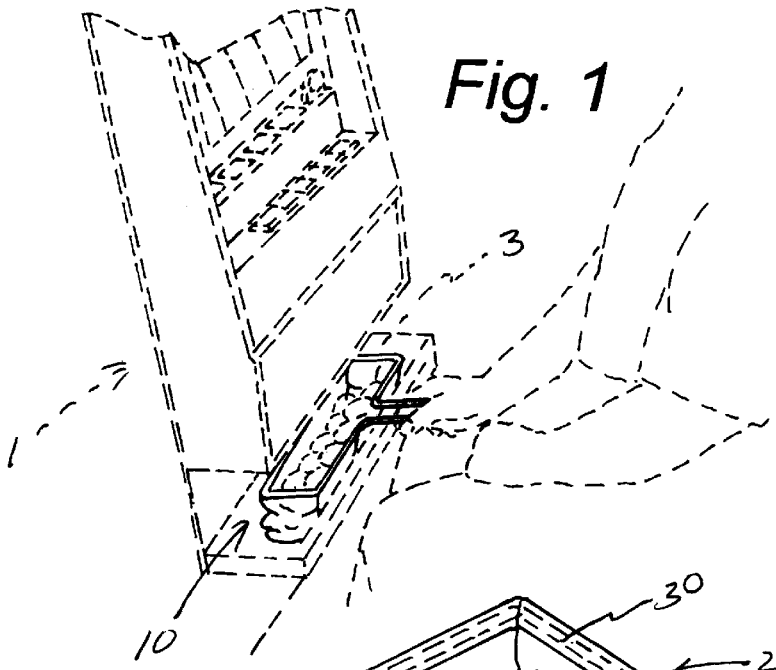
FIG. 1 is a perspective view showing the slot machine coin container of the present invention positioned in the coin tray of a slot machine.
Figure 2:
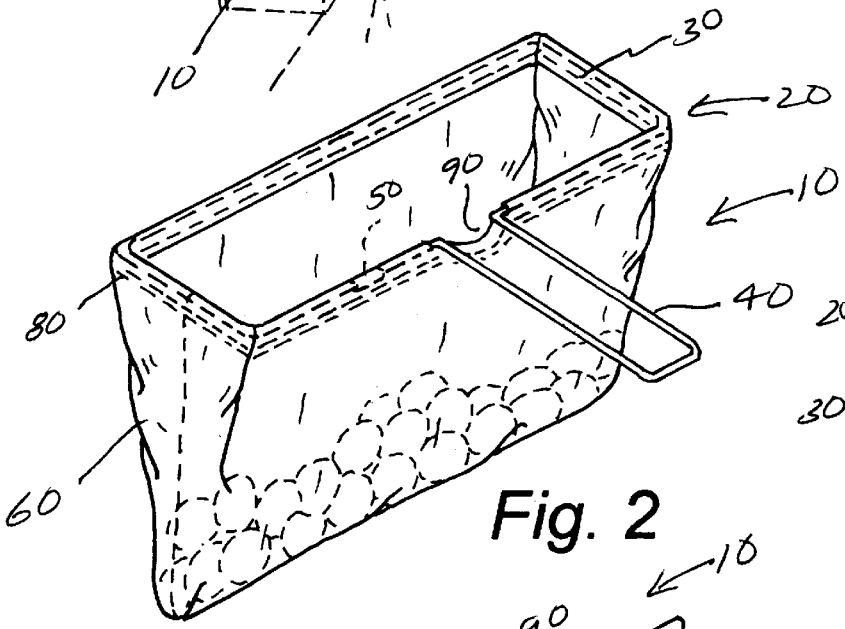
FIG. 2 is an enlarged perspective view showing the coin container with the frame in the horizontal position.
Figure 3:
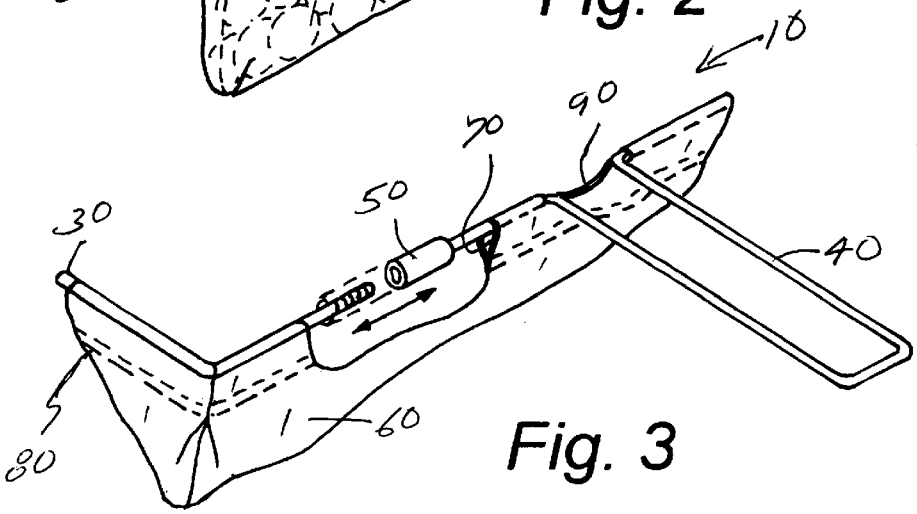
FIG. 3 is a partial perspective view showing the threaded connector that may be used to replace the flexible bag of the container.

As can be seen by reference to the drawings, and in particularly to FIG. 1, the slot machine coin container that forms the basis of the present invention is designated generally by the reference number 10. The coin container 10 is adapted for use with a slot machine 1 having a generally rectangularly shaped coin tray 3. The container 10 includes a frame 20 having a bag supporting section 30 shaped to conform to the shape of the coin tray and a handle section 40 that extends out from the bag supporting section 30. The frame 20 may be formed of a continuous round rod bent in the fashion illustrated in the drawings. Adjacent ends of the rod may be selectively connected by a threaded connector 50 as shown in FIG. 3. Although the bag supporting section 30 and the handle section 40 are shown to lie in the same plane, it is possible to form them angularly disposed with respect to each other if desired. Also, it is understood that the handle section 40 may carry a strong plastic or metal alloy grip or could be attached to a patron's belt with an optional belt clip.

The flexible bag 60 may be formed of a durable cloth or other material such as vinyl or plastic. The bag 60 includes a top channel 70 that is closed by stitching 80 with an access opening 90 to selectively receive the bag supporting section 30 of the frame 20, such as shown in FIG. 3.

Figure 4:
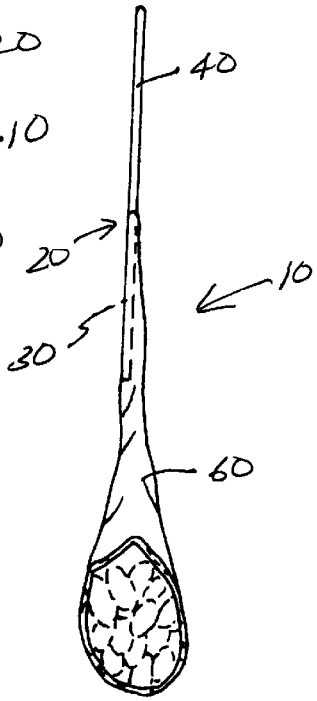
FIG. 4 is a perspective view showing the coin container with the frame in the vertical position such as that normally used when carrying coins from the slot machine to the casino cashier.

In use, the flexible bag 60 that depends from the bag supporting section 30 of the frame 20 is horizontally positioned in the coin tray 3 below the coin discharge of the slot machine 1. Coins are then directly discharged into the bag 60. Alternatively, the frame 20 could be held in a horizontal position against the front of the coin tray 3, and coins could then be raked into the flexible bag 60. When the bag 60 is filled with coins, the handle section 40 is gripped by the patron with the frame 20 in the vertical position as illustrated in FIG. 4. This acts to automatically close the top of the flexible bag 60 as the coins are carried to the casino cashier. The container 10 can then be handed to the cashier who can dump the contents into the coin counter and return the container 10 to the patron. Use of the container 10 will be much more convenient than using the coin buckets currently provided by the casinos. Also, the container 10 could be provided as an inexpensive promotional item with logos printed or embroidered on the bags 60.

Although only an exemplary embodiment of the invention has been described in detail above, those skilled in the art will readily appreciate that many modifications are possible without materially departing from the novel teachings and advantages of this invention. Accordingly, all such, modifications are intended to be included within the scope of this invention as defined the following claims.

What is claimed is:

1. A coin receiving and carrying container adapted for use with a slot machine having a generally rectangularly shaped coin tray, the coin container comprising:

a frame including a generally elongated rectangular bag supporting section dimensioned to be received in the generally rectangular shaped coin tray of a slot machine and a generally U-shaped handle section formed integrally with and extending outwardly in the same plane as the bag supporting section; wherein, both the bag supporting section and the handle section are formed from a continuous rod whose opposite ends are releasably connected together; and, a flexible bag attached to and suspended directly downwardly from the bag supporting section.

2. The coin container of claim 1; wherein, the frame includes a threaded connector attached to and disposed to selectively connect adjacent portions of the bag supporting section.

3. The coin container of claim 2; wherein, the flexible bag includes a top closed channel with an access opening disposed to selectively receive the bag supporting section of the frame.

4. The coin container of claim 3; wherein, the bag is formed of a durable cloth.

* * * * *